United States Patent [19]

Keydel

[11] 4,037,540

[45] July 26, 1977

[54] DIRECTIONAL ANTENNA FOR A PROJECTILE OR ROCKET DETONATOR

[75] Inventor: Wolfgang Keydel, Ulm (Danube), Germany

[73] Assignee: Licentia Patent-Verwaltungs-G.m.b.H., Frankfurt am Main, Germany

[21] Appl. No.: 630,893

[22] Filed: Nov. 11, 1975

[30] Foreign Application Priority Data

Nov. 16, 1975 Germany ..... 2454528

[51] Int. Cl.[2] ..... F42C 13/04; F42C 13/00; H01Q 13/10; H01Q 13/18

[52] U.S. Cl. ..... 102/70.2 P; 343/769; 343/708

[58] Field of Search ..... 102/70.2 P; 343/705, 343/708, 769

[56] References Cited

U.S. PATENT DOCUMENTS

| | | | |
|---|---|---|---|
| 2,611,865 | 9/1952 | Alford | 343/769 |
| 2,867,803 | 1/1959 | Kerley | 343/769 |
| 3,074,063 | 1/1963 | Horton | 102/70.2 P |
| 3,127,609 | 3/1964 | Wentworth | 343/708 |
| 3,293,645 | 12/1966 | Farley et al. | 343/769 |
| 3,346,865 | 10/1967 | Jones, Jr. | 343/708 |
| 3,518,685 | 6/1970 | Jones, Jr. | 343/708 |
| 3,914,767 | 10/1975 | Jones, Jr. | 343/708 |

*Primary Examiner*—Samuel W. Engle
*Assistant Examiner*—Thomas H. Webb
*Attorney, Agent, or Firm*—Spencer & Kaye

[57] ABSTRACT

In a projectile or rocket having a metal outer shell and including a proximity or influence detonator which operates with electromagnetic waves, particularly according to the reflected beam principle, and a directional antenna with a rotationally symmetrical radiation diagram for said detonator, the antenna is constituted by a circular slot which is coaxial with the longitudinal axis of the projectile or rocket and the antenna is excited with a line or cavity resonator disposed in the projectile or rocket and connected between the detonator and the antenna.

17 Claims, 5 Drawing Figures

——— CIRCULAR SLOT IN A CONE
SLOT SPACING $a=0{,}5\lambda$ (ACCORDING TO SILVER)

— — — — $E_\vartheta = \sin_\vartheta$
CONE APERTURE $2\vartheta = 30°$

DIRECTIONAL ANTENNA FOR A PROJECTILE OR ROCKET DETONATOR

BACKGROUND OF THE INVENTION

The present invention relates to a directional antenna with a rotationally symmetrical radiation diagram for proximity or influence detonators for a projectile wherein the detonator operates with electromagnetic waves and particularly according to the reflected beam principle.

SUMMARY OF THE INVENTION

It is the object of the present invention to provide a directional antenna of this type in which the space requirement is small compared to the state of the art antenna and in which the radiation diagram substantially approaches the ideal circular characteristic even for projectiles with rifling. The attainable radiation energy should be sufficient in a direction obliquely forward and perpendicular to the longitudinal axis of the projectile or rocket, respectively, within this characteristic.

The above object is achieved according to the present invention in that in a projectile or rocket having a metal outer shell and including a detonator and antenna of the above-identified types, the directional antenna is constituted by a circular slot which is formed in the outer shell and which is coaxial with the longitudinal axis of the projectile or rocket and resonator means, which may be a line or a cavity resonator, are provided in the projectile for exciting the antenna.

The antenna according to the invention is preferably dimensioned in the form of a magnetic resonator antenna. The exciter resonator for the antenna is advisably cylindrical or conical.

When the antenna according to the invention is excited with the fundamental wave, a radiation diagram results which has a zero point in the direction of flight of the projectile or rocket, respectively. This zero point can advantageously be eliminated in that the antenna is excited with a higher wave mode that the fundamental wave.

DETAILED DESCRIPTION OF THE PREFERRED EMBODIMENTS

Before turning to the figures, it should be pointed out that the invention, its advantageous embodiments and its modifications are based on the following considerations:

Just as a ring through which current flows can be excited to radiate and be used as an antenna, it is possible to use a circular, ring-shaped, narrow slot around a projectile or rocket as its antenna. According to the Babinet principle, both arrangements are complementary to one another. In principle, such antennas have the same data with respect to polarization, rotational symmetry and signal to noise ratio. The rotational symmetry of the directional diagram of a magnetic loop is improved compared to that of an electric loop because nothing, particularly no lines, interfere with the symmetry. This statement applies for any ideal case of a circular magnetic loop on an infinitely well conducting and infinitely long cylinder.

Such conditions are not available for an antenna of the type provided by the invention. The surface of a projectile, particularly its tip, or of a rocket (of course with the exception of the radiating slot) could be metallized, but then one would still not have an infinitely long cylinder but only a good approximation of an infinitely long cone.

Circular slots in cones are known per se in the microwave art (see L. L. Bailin and S. Silver, *Exterior Electromagnetic Boundary Value Problems for Spheres and Cones,* IRE Trans. AP, 1956, pages 5–16; D. G. Pridmore-Brown and G. E. Stewart, *Radiation from Slot Antennas on Cones,* The Aerospace Corporation Air Force Report No. SAMSO-TR-71-77).

Figure 1:
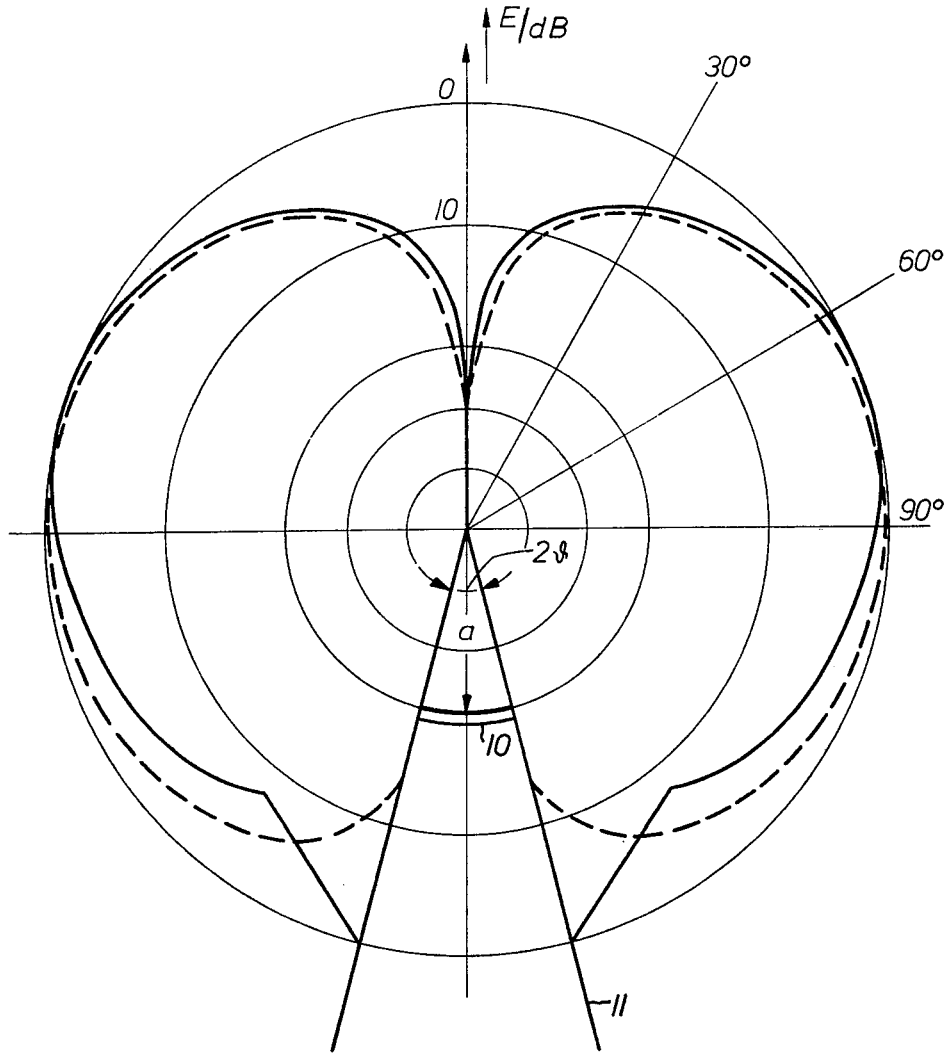
FIG. 1 is a directional diagram of radiation pattern of a circular slot antenna according to the invention.

FIG. 1 shows in solid line the directional diagram of a circular slot 10 which is applied to a cone 11 at a distance $a$ of $\lambda/2$, where $\lambda$ is the wavelength of the fundamental wave, from the tip of the cone. For the sake of comparison the diagram also shows, in dashed lines, a sinusoidal remote field. If it is possible to excite such a circular slot, the problem on which the present invention is based can be solved in an advantageous manner. The excitation of such a circular slot according to the present invention is effected via a resonator, which may be either a line resonator or a cavity resonator.

Figure 2:
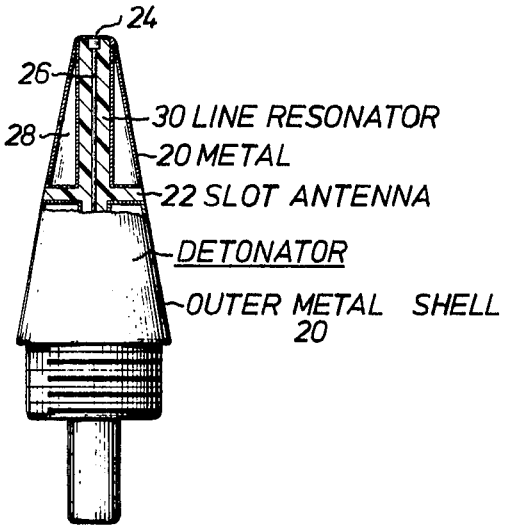
FIG. 2 is a schematic sectional view of a projectile detonator with an antenna and a cylindrical line resonator according to an embodiment of the invention.
Figure 3:
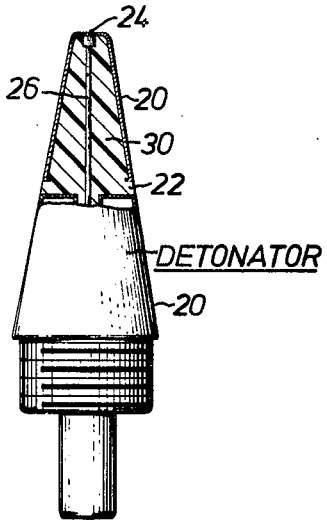
FIG. 3 is a schematic sectional view of a projectile detonator with an antenna and a conical line resonator according to a further embodiment of the invention.
Figure 4:
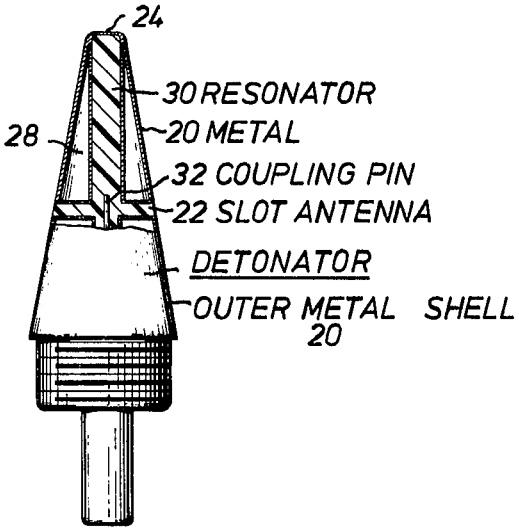
FIG. 4 is a schematic sectional view of a projectile detonator with an antenna and a cylindrical cavity resonator according to another embodiment of the invention.
Figure 5:
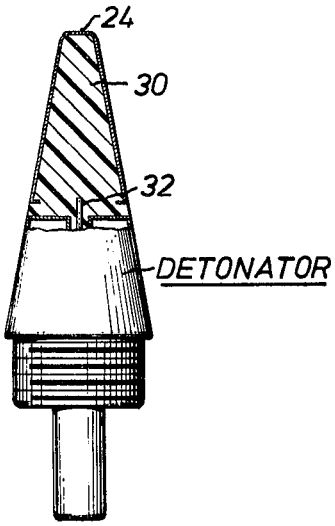
FIG. 5 is a schematic sectional view of a projectile detonator with an antenna and conical cavity resonator according to still a further embodiment of the invention.

Referring now to FIGS. 2 to 5, there are shown various possibilities for excitation of an antenna according to the invention for a projectile without thus limiting the invention to the illustrated possibilities. FIGS. 2 and 3 show two different configurations of line resonators for exciting the slot antenna while FIGS. 4 and 5 show two different configurations of cavity resonators for exciting the slot antenna. In all embodiments the same reference numerals are used to designate the same elements. Additionally, in all embodiments, the slot antenna is advisably operated as a resonator antenna.

Referring now to FIG. 2 there is schematically shown a detonator of the type to which the present invention relates and which is well known in the art. As is conventional, such a detonator forms the front portion of a projectile or rocket, the major portion of which is not shown in the drawings, and has a conical outer surface which is formed by a metal outer shell 20. Formed within the outer shell 20 is a circular slot 22 which is coaxial with the longitudinal axis of the detonator, and hence of the projectile or rocket, and which constitutes the slot antenna for the detonator. In order to excite the slot antenna 22, according to the invention, a resonator is coupled between the detonator and the antenna 22. In this embodiment of the invention the resonator is a line resonator which is disposed within the projectile between the circular slot antenna 22 and the tip 24 of the projectile and whose major axis coincides with the longitudinal axis of the projectile. In order to form the line resonator, the portion of the outer metal shell 20 between the circular slot antenna 22 and the projectile tip 24 is essentially hollow and the detonator itself is coupled to the resonator via the center conductor 26 of a coaxial line which center conductor 26 extends along the longitudinal axis of the projectile or missile and is coupled, either directly or capacitively, to the inner surface of the outer metal shell 20 at the tip 24 of the projectile. According to the embodiment of FIG. 2, the resonator is a cylindrical line resonator and therefore the portion of the shell 20 between the slot 22 and the tip 24 is provided with a substantially triangular longitudinal cross section as indicated by the reference numeral 28 so as to form a substantially cylindrical cavity 30 which is symmetrical with respect to the longitudinal axis of the projectile. Preferably, as shown, the cavity 30 is filled with a solid dielectric medium.

FIG. 3 shows a line resonator similar to that of FIG. 2 with the exception that the resonator is a conical line resonator and accordingly the cavity filled with dielectric is conical in shape and conforms to the outer shape of the shell 20.

FIGS. 4 and 5 show resonators having shapes similar to those of FIGS. 2 and 3 respectively but utilizing cavity resonators instead of line resonators. Accordingly in these embodiments the detonators are coupled to the respective cavity resonators by means of a coupling pin 32 in the vicinity of the slot 22. Preferably, in all embodiments of the invention the distance of the slot 22 from the tip of the projectile should be $\lambda/2$, but different distances may be chosen for constructional reasons.

The length of the cavity or line resonator is not critical. The position of slot 22 should be in a region of a maximum of the resonator current; e.g., if the electrical length of the cavity or line resonator is $\lambda/2$ then the slot position must be in a distance or $\lambda/2$ from the tip of the cavity or line resonator as shown in FIGS. 2 through 5.

The size, i.e., the height of the slot is not critical as long as it is small compared to $\lambda/2$. Nevertheless, if the height of the slot is very small then the bandwidth of the antenna is restricted. The invention is not limited to projectiles of cone shaped tips.

The portion of the metal coating or shell below the slot 22 is generally connected to the outer conductor of a coaxial line, which is the antenna feeder line.

FIGS. 2 to 5 show that cylindrical or conical resonators are of advantage. The operating frequency of such an arrangement is limited at the lower end only by the coupling to the body of the projectile and by the losses of the dielectric medium in the resonator. Due to the radiation resistance, which decreases with decreasing circumference, the slot periphery has a certain significance in this connection. In the illustrated embodiment the maximum slot circumference $S_{max}$ in the drawing figures, which show embodiments of the invention to a scale of 1:1, is given by $S_{max} = D \cdot \pi$ cm $S_{max} = 4.7$ cm for $D = 1.5$ cm With a requirement for $S = \lambda/4$ the maximum wavelength $\lambda_{max}$ is calculated as follows:

$\lambda_{max} = 18.9$ cm

This corresponds to a frequency of $f_{min} = 1.6$ GHz

The upper frequency limits for use of the invention in practice are given only by the excitability of the slots, i.e., such a circular slot antenna can be designed for a minimum of 1.6GHz to 4GHz. If one departs from the requirement that $S = \lambda/4$, the frequency range becomes correspondingly broader. The broadbandedness depends on the quality of the resonators. It will be possible in practice to attain at least a broadbandedness of 3% with respect to the center frequency.

The zero point of the diagram of FIG. 1 which appears in the direction of the tip of the cone can be eliminated in that the resonator is excited with the fundamental wave mode but rather with higher wave modes.

It will be understood that the above description of the present invention is susceptible to various modifications, changes and adaptations, and the same are intended to be comprehended within the meaning and range of equivalents of the appended claims.

What is claimed is:

1. In a projectile or rocket having a metal outer shell and including a proximity or influence detonator operating with electromagnetic waves, particularly according to the reflected beam principle, and a directional antenna having a rotationally symmetrical radiation diagram for said detonator, the improvement wherein said antenna is constituted by a circular slot which is formed in said outer shell and which is coaxial with the longitudinal axis of the said projectile or rocket; and further comprising resonator means disposed within said outer shell, and coupled between said antenna and said detonator for exciting said circular slot.

2. Apparatus as defined in claim 1 wherein said antenna is dimensioned to operate as a resonator antenna.

3. Apparatus as defined in claim 1 wherein said resonator means is a line resonator.

4. Apparatus as defined in claim 3 wherein said resonator means is a cylindrical line resonator.

5. Apparatus as defined in claim 3 wherein said resonator means is a conical line resonator.

6. Apparatus as defined in claim 3 wherein: said line resonator is disposed between the tip of said projectile or rocket and said circular slot, with the major axis of said resonator coinciding with the longitudinal axis of said projectile or rocket; and means for coupling said detonator to said resonator at the end of said resonator disposed opposite said circular slot.

7. Apparatus as defined in claim 6 wherein said line resonator is conically designed and occupies the major portion of the structural volume between the tip of said projectile or rocket and said circular slot.

8. Apparatus as defined in claim 6 wherein: said outer shell is conical at the portion thereof approaching the tip of said projectile or rocket, said circular slot is formed on the conical portion of said outer shell, said shell is substantially hollow between said circular slot and the tip of said projectile or rocket and said line resonator is formed by a conductor extending along the longitudinal axis of said projectile or rocket and having one end connected to said detonator and its other end coupled to said outer shell at the tip of said projectile or rocket.

9. Apparatus as defined in claim 1 wherein said resonator means is a cavity resonator.

10. Apparatus as defined in claim 9 wherein said cavity resonator is a conical cavity resonator.

11. Apparatus as defined in claim 9 wherein said cavity resonator is a cylindrical cavity resonator.

12. Apparatus as defined in claim 9 wherein said cavity resonator is disposed between the tip of said projectile or rocket and said circular slot with the major axis of said resonator coinciding with the longitudinal axis of said projectile or rocket and means for coupling said detonator to said resonator at the end of said resonator which is adjacent said circular slot.

13. Apparatus as defined in claim 12 wherein said means for coupling comprises a coupling pin disposed along the longitudinal axis of said projectile and having one end connected to said detonator and its other end extending into the cavity of said resonator.

14. Apparatus as defined in claim 12 wherein said cavity resonator is conically designed and occupies the major portion of the structural volume between the tip of said projectile and said circular slot.

15. Apparatus as defined in claim 14 wherein said outer shell is conical at the portion thereof approaching the tip of said projectile or rocket, said circular slot is formed on the conical portion of said outer shell, and said outer shell is substantially hollow between said circular slot and the tip of said projectile or rocket to form said cavity resonator.

16. Apparatus as defined in claim 1 wherein said resonator means comprise means for exciting said antenna with a wave mode which is higher that the fundamental mode.

17. Apparatus as defined in claim 1 wherein said circular slot is spaced at a distance of $\lambda/2$ from the tip of said projectile.

* * * * *